US009677798B2

(12) United States Patent
Nakai et al.

(10) Patent No.: US 9,677,798 B2
(45) Date of Patent: Jun. 13, 2017

(54) REFRIGERATING DEVICE

(71) Applicant: DAIKIN INDUSTRIES, LTD., Osaka-shi, Osaka (JP)

(72) Inventors: Akinori Nakai, Kusatsu (JP); Daisuke Toyoda, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 14/407,428

(22) PCT Filed: Apr. 30, 2013

(86) PCT No.: PCT/JP2013/062621
§ 371 (c)(1),
(2) Date: Dec. 11, 2014

(87) PCT Pub. No.: WO2013/187147
PCT Pub. Date: Dec. 19, 2013

(65) Prior Publication Data
US 2015/0153085 A1 Jun. 4, 2015

(30) Foreign Application Priority Data
Jun. 13, 2012 (JP) ..... 2012-133932

(51) Int. Cl.
*F25B 41/04* (2006.01)
*F25B 1/00* (2006.01)
(Continued)

(52) U.S. Cl.
CPC ..... *F25B 49/022* (2013.01); *F25B 13/00* (2013.01); *F25B 49/005* (2013.01);
(Continued)

(58) Field of Classification Search
CPC .... F25B 49/022; F25B 13/00; F25B 2500/08; F25B 2500/26; F25B 2700/21152;
(Continued)

(56) References Cited

U.S. PATENT DOCUMENTS

2005/0223722 A1* 10/2005 Yamashita et al. ..... 62/157
2005/0235660 A1* 10/2005 Pham ..... 62/126
2007/0062207 A1* 3/2007 Aiyama et al. ..... 62/222

FOREIGN PATENT DOCUMENTS

EP 2 015 004 A1 1/2009
EP 2 428 752 A1 3/2012
(Continued)

OTHER PUBLICATIONS

Toshinari et al., Protection Controller for Frequency Controlled Air Conditioner, Jun. 2, 1995, JPH07139858A, Whole Document.*
(Continued)

*Primary Examiner* — Larry Furdge
(74) *Attorney, Agent, or Firm* — Global IP Counselors, LLP

(57) ABSTRACT

A refrigerating device includes a compressor, a temperature detector and a protection control section. The compressor compresses a refrigerant. The temperature detector detects a temperature of the refrigerant discharged from the compressor on an outside of the compressor. The protection control section judges that a transition following a starting of the compressor is in effect and that a steady state following an end of the transition in which a state of the refrigerant is stable is in effect, performs protection control on the compressor when a detected temperature detected by the temperature detector exceeds a first determination temperature during the transition, and performs the protection control on the compressor when the detected temperature exceeds a second determination temperature during the steady state.

6 Claims, 5 Drawing Sheets

(51) Int. Cl.

| | |
|---|---|
| ***F25B 49/00*** | (2006.01) |
| ***F25B 49/02*** | (2006.01) |
| ***F25B 13/00*** | (2006.01) |

(52) U.S. Cl.
CPC ... *F25B 2313/005* (2013.01); *F25B 2313/006* (2013.01); *F25B 2313/0233* (2013.01); *F25B 2313/02741* (2013.01); *F25B 2500/08* (2013.01); *F25B 2500/26* (2013.01); *F25B 2600/025* (2013.01); *F25B 2600/23* (2013.01); *F25B 2700/21152* (2013.01)

(58) Field of Classification Search
CPC ..... F25B 2313/005; F25B 2600/23; F25B 2313/02741; F25B 2313/006; F25B 2600/025; F25B 2313/0233
See application file for complete search history.

(56) References Cited

FOREIGN PATENT DOCUMENTS

| | | | | |
|---|---|---|---|---|
| JP | H07139858 | A | * | 6/1995 |
| JP | 2002-107016 | A | | 4/2002 |
| JP | 2009-58197 | A | | 3/2009 |
| JP | 2009-281191 | A | | 12/2009 |

OTHER PUBLICATIONS

European Search Report of corresponding EP Application No. 13 80 3544.9 dated Jun. 2, 2015.
International Preliminary Report of corresponding PCT Application No. PCT/JP2013/062621 dated Dec. 16, 2014.
International Search Report of corresponding PCT Application No. PCT/JP2013/062621 dated Jul. 30, 2013.

* cited by examiner

REFRIGERATING DEVICE

CROSS-REFERENCE TO RELATED APPLICATIONS

This U.S. National stage application claims priority under 35 U.S.C. §119(a) to Japanese Patent Application No. 2012-133932, filed in Japan on Jun. 13, 2012, the entire contents of which are hereby incorporated herein by reference.

TECHNICAL HELD

The present invention relates to a refrigerating device.

BACKGROUND ART

Refrigerating devices are known to have configurations such that, in order to prevent breakages and lower performance of a compressor which configures a refrigerant circuit due to overheating, a temperature of a discharge pipe of the compressor is monitored and a protection control is performed on the compressor when this temperature is larger than a determination temperature.

To protect the compressor, it is more preferable to monitor the internal temperature of the compressor, which is higher than the temperature of the discharge pipe, in more detail, to monitor the temperature of refrigerant immediately after being discharged from a compression chamber (the temperature of a discharge port) or the temperature of a motor, than to monitor the temperature of the discharge pipe of the compressor. However, it is difficult to install a temperature detector in the compressor interior because this leads to an increase in manufacturing cost; therefore, a determination temperature is decided with the presupposition that there will be a fixed temperature difference between the internal temperature of the compressor and the temperature of the discharge pipe, and protection control is performed using the temperature of the discharge pipe of the compressor.

However, when an inverter compressor is used, the circulating amount of refrigerant changes, and the temperature difference between the internal temperature of the compressor and the temperature of the discharge pipe could therefore change as well. With regard to this, Japanese Laid-open Patent Application No. 2002-107016 discloses a configuration in which the determination temperature is varied according to the driving frequency of the inverter compressor (the circulating amount of refrigerant).

SUMMARY

Technical Problem

However, the inventors of the present application found that, even if the circulating amount of refrigerant is fixed, the temperature difference between the temperature of the discharge pipe and the internal temperature of the compressor could change between during a startup of the compressor and during steady operation of the compressor.

An object of the present invention is to provide a highly reliable refrigerating device in which appropriate protection control is reliably performed even during a startup of a compressor when a temperature of a refrigerant is measured outside of the compressor and the protection control is performed based on this temperature.

Solution to Problem

A refrigerating device according to a first aspect of the present invention comprises a compressor, a temperature detector, and a protection control section. The compressor compresses a refrigerant. The temperature detector detects a temperature of the refrigerant discharged from the compressor on the outside of the compressor. The protection control section judges that a transition following a starting of the compressor is in effect and that a steady state following an end of the transition in which a state of the refrigerant is stable is in effect, performs protection control on the compressor when the detected temperature detected by the temperature detector exceeds a first determination temperature during the transition, and performs the protection control on the compressor when the detected temperature exceeds a second determination temperature during the steady state.

According to the aspect described above, transitions following the starting of the compressor and steady states in which the state of the refrigerant is stable are judged, and protection control of the compressor is performed based on the determination temperature which is different between during transitions and during steady states. Therefore, even when the temperature difference between the detected temperature and the internal temperature of the compressor during a transition is different from the temperature difference between the detected temperature and the internal temperature of the compressor during a steady state, appropriate protection control can be performed before the interior of the compressor overheats. As a result, a highly reliable refrigerating device is achieved.

A refrigerating device according to a second aspect of the present invention is the refrigerating device according to the first aspect, wherein the transition includes a timing when a suction pressure of the compressor reaches a local minimum.

Here, the transition can be judged using the change in the suction pressure of the compressor. The transition therefore can be determined in a simple and appropriate manner without performing actual measurement of the temperature difference between the internal temperature of the compressor and the detected temperature during trial operation or the like and the appropriate protection control can be performed before the interior of the compressor overheats. As a result, a highly reliable refrigerating device is achieved.

Here, the term "a timing when the suction pressure of the compressor reaches a local minimum" refers to a timing when the suction pressure of the compressor begins to increase after it decreases to a minimum value after the starting of the compressor.

A refrigerating device according to a third aspect of the present invention is the refrigerating device according to the first or second aspect, wherein the protection control section judges that the transition is in effect until a predetermined time elapses after the starting of the compressor, and judges that the steady state is in effect after the predetermined time has elapsed.

Because transitions and steady states are judged using the time after the starting of the compressor, the end of the transition can easily be judged to vary the determination temperature. Therefore, the appropriate protection control can be performed before the interior of the compressor overheats. As a result, a highly reliable refrigerating device is achieved.

A refrigerating device according to a fourth aspect of the present invention is the refrigerating device according to any of the first through third aspects, wherein the first determination temperature is less than the second determination temperature.

The appropriate protection control can be performed when the temperature difference between the detected temperature and the internal temperature of the compressor could be greater during a transition following a starting of the compressor than during a steady state.

Advantageous Effects of Invention

In the refrigerating device according to the first aspect of the present invention, transitions following the starting of the compressor and steady states in which the state of the refrigerant is stable are judged, and protection control of the compressor is performed based on the determination temperatures which is different between during transitions and during steady states. Therefore, even when the temperature difference between the detected temperature and the internal temperature of the compressor during a transition is different from the temperature difference between the detected temperature and the internal temperature of the compressor during a steady state, appropriate protection control can be performed before the interior of the compressor overheats. As a result, a highly reliable refrigerating device is achieved.

In the refrigerating device according to the second aspect of the present invention, a transition can be determined in a simple and appropriate manner and the appropriate protection control can be performed before the interior of the compressor overheats. As a result, a highly reliable refrigerating device is achieved.

In the refrigerating device according to the third aspect of the present invention, the end of the transition can easily be judged to vary the determination temperature. Therefore, the appropriate protection control can be performed before the interior of the compressor overheats. As a result, a highly reliable refrigerating device is achieved.

In the refrigerating device according to the fourth aspect of the present invention, the appropriate protection control can be performed when the temperature difference between the detected temperature and the internal temperature of the compressor is greater during a transition following a starting of the compressor than during a steady state.

DESCRIPTION OF EMBODIMENTS

An embodiment of the present invention is described below with reference to the drawings. The following embodiment of the present invention can be modified as appropriate within a range that does not deviate from the scope of the present invention.

(1) Overall Configuration

An air conditioning device 1, given as an embodiment of a refrigerating device according to the present invention, is capable of operating while switching between a cooling operation and a heating operation.

Figure 1:
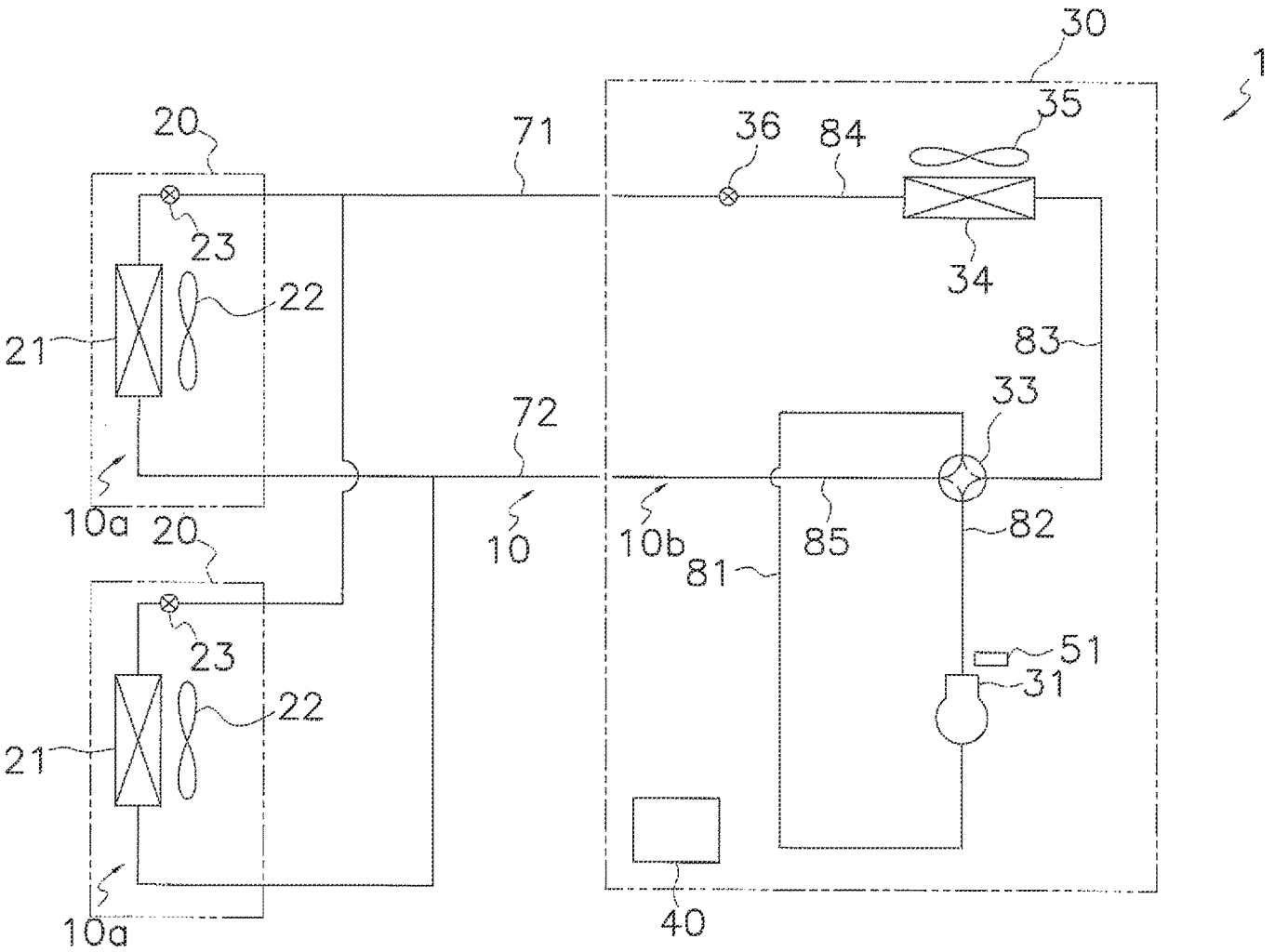
FIG. 1 is a schematic diagram of an air conditioning device according to an embodiment of the present invention.

The air conditioning device 1 has primarily indoor units 20, an outdoor unit 30, and a control unit 40, as shown in FIG. 1. There are two indoor units 20 in FIG. 1, but there may be three or more or only one.

The air conditioning device 1 has a refrigerant circuit 10 filled with R32 as a refrigerant. The refrigerant circuit 10 has indoor side circuits 10*a* accommodated in the indoor units 20, and an outdoor side circuit 10*b* accommodated in the outdoor unit 30. The indoor side circuits 10*a* and the outdoor side circuit 10*b* are connected by a liquid refrigerant communication piping 71 and a gas refrigerant communication piping 72.

(2) Detailed Configuration (2-1) Indoor Units

The indoor units 20 are installed in a room to be air-conditioned. The indoor units 20 have indoor heat exchangers 21, indoor fans 22, and indoor expansion valves 23.

The indoor heat exchangers 21 are cross-fin type fin-and-tube heat exchangers configured from heat transfer tubes and numerous heat transfer fins. The heat exchanges function as evaporators of the refrigerant to cool indoor air during the cooling operation, and function as condensers of the refrigerant to heat indoor air during the heating operation. The liquid sides of the indoor heat exchangers 21 are connected to the liquid refrigerant communication piping 71, and the gas sides of the indoor heat exchangers 21 are connected to the gas refrigerant communication piping 72.

The indoor fans 22, which are caused to rotate by fan motors (not shown), takes in indoor air and blows it onto the indoor heat exchangers 21 so as to facilitate heat exchange between the indoor heat exchangers 21 and the indoor air.

The indoor expansion valves 23 are electric expansion valves provided in order to adjust a pressure and a flow rate of the refrigerant flowing within the indoor side circuits 10*a* of the refrigerant circuit 10, and the opening degrees of these valves can be varied.

(2-2) Outdoor Unit

The outdoor unit 30 has primarily a compressor 31, a four-way switching valve 33, an outdoor heat exchanger 34, an outdoor expansion valve 36, an outdoor fan 35, and a discharge pipe temperature sensor 51. The compressor 31, the four-way switching valve 33, the outdoor heat exchanger 34, and the outdoor expansion valve 36 are connected by refrigerant piping.

(2-2-1) Connection of Components by Refrigerant Piping

The connection of the components of the outdoor unit 30 by the refrigerant piping will now be described.

An suction port of the compressor 31 and the four-way switching valve 33 are connected by a suction pipe 81. A discharge port of the compressor 31 and the four-way switching valve 33 are connected by a discharge pipe 82. The four-way switching valve 33 and a gas side of the outdoor heat exchanger 34 are connected by a first gas refrigerant pipe 83. The outdoor heat exchanger 34 and the liquid refrigerant communication piping 71 are connected by a liquid refrigerant pipe 84. The outdoor expansion valve 36 is provided to the liquid refrigerant pipe 84. The four-way switching valve 33 and the gas refrigerant communication piping 72 are connected by a second gas refrigerant pipe 85.

The discharge pipe 82 is provided with a discharge pipe temperature sensor 51 in order to perceive the temperature of the refrigerant discharged from the compressor 31.

(2-2-2) Compressor

In the compressor 31, a compression mechanism is driven by a motor and gas refrigerant is compressed. The compressor 31 is an inverter-type compressor in which the driving frequency f can be varied. The compressor 31 sucks in gas refrigerant from the suction pipe 81 and discharges high-temperature, high-pressure gas refrigerant compressed by the compression mechanism to the discharge pipe 82. The compressor 31 is a rotary compressor, but no limitation is provided thereby; the compressor 31 may also be, for example, a scroll compressor.

(2-2-3) Four-Way Switching Valve

The four-way switching valve 33 switches the direction of refrigerant flow when switching between the cooling operation and the heating operation of the air conditioning device 1. During the cooling operation, the discharge pipe 82 and the first gas refrigerant pipe 83 are connected, and the suction pipe 81 and the second gas refrigerant pipe 85 are connected. During the heating operation, the discharge pipe 82 and the second gas refrigerant pipe 85 are connected, and the suction pipe 81 and the first gas refrigerant pipe 83 are connected.

(2-2-4) Outdoor Heat Exchanger

The outdoor heat exchanger 34 is a cross-fin type fin-and-pipe heat exchanger configured from a heat transfer pipe and numerous heat transfer fins. The outdoor heat exchanger 34 functions as a condenser of the refrigerant during the cooling operation and as an evaporator of the refrigerant during the heating operation, through the exchange of heat with outdoor air.

(2-2-5) Outdoor Fans

The outdoor fan 35, which is caused to rotate by a fan motor (not shown), draws outdoor air into the outdoor unit 30. The drawn-in outdoor air passes through the outdoor heat exchanger 34 and is ultimately expelled from the outdoor unit 30. The outdoor fan 35 promotes the exchange of heat between the outdoor heat exchanger 34 and the outdoor air.

(2-2-6) Outdoor Expansion Valve

The outdoor expansion valve 36 is an expansion mechanism. The outdoor expansion valve 36 is an electric expansion valve in which the opening degree can be varied and is provided in order to adjust the pressure and flow rate of refrigerant flowing within the outdoor side circuit 101) of the refrigerant circuit 10.

(2-2-7) Discharge Pipe Temperature Sensor

The discharge pipe temperature sensor 51 is a thermistor configured and arranged to detect the temperature of the refrigerant discharged from the compressor 31, and is an example of a temperature detector. The discharge pipe temperature sensor 51 is provided in the exterior of the compressor 31; i.e., to the discharge pipe 82 in the proximity of the discharge port of the compressor 31. A signal corresponding to the temperature detected by the discharge pipe temperature sensor 51 is transmitted to a detection signal receiving section 41*a* of the control unit 40, described hereinafter.

(2-3) Control Unit

Figure 2:
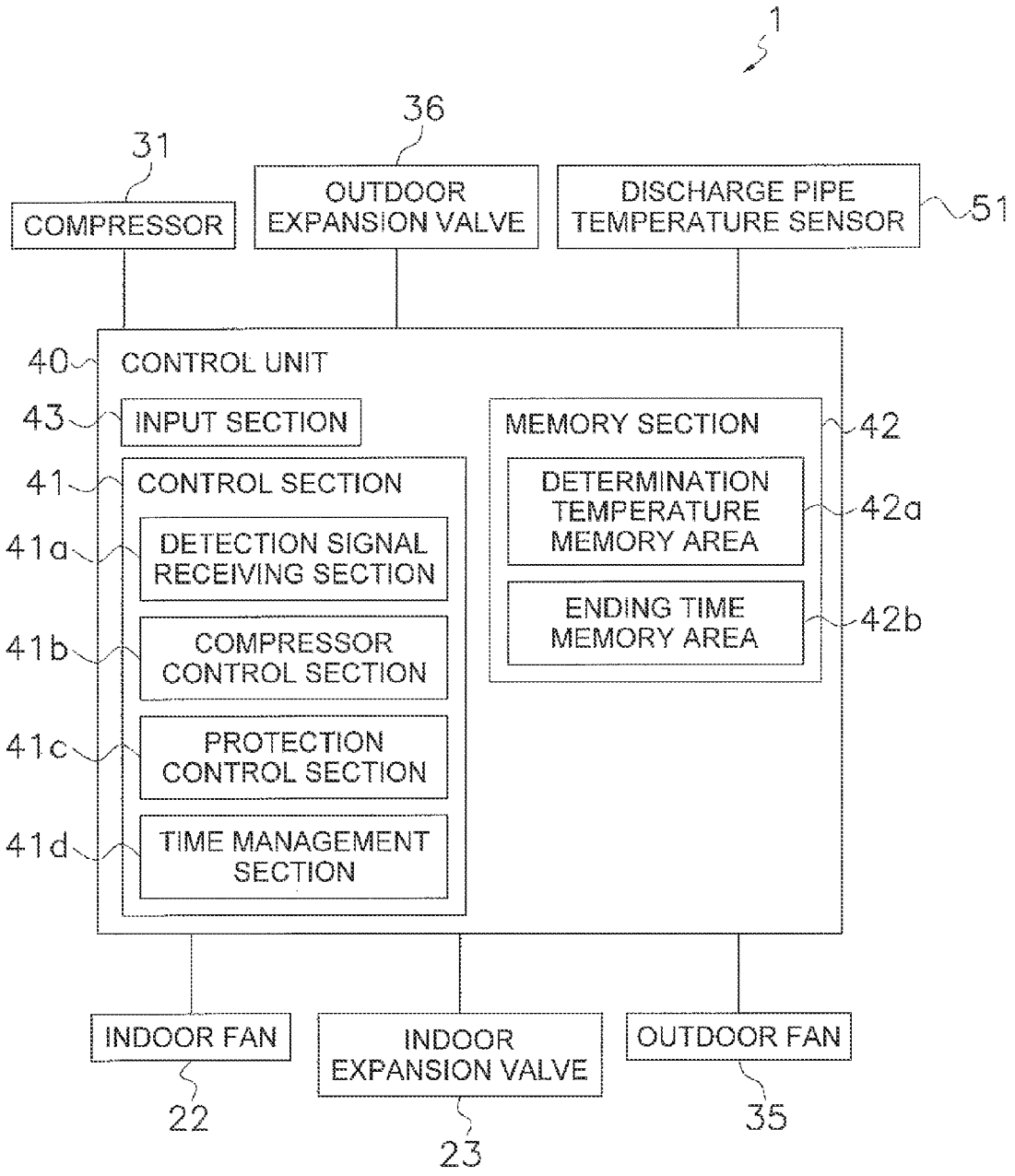
FIG. 2 is a block diagram of the air conditioning device of FIG. 1.

The control unit 40 controls the indoor units 20 and the outdoor unit 30. FIG. 2 shows a block diagram of the air conditioning device 1 including the control unit 40.

The control unit 40 has a control section 41 comprising a microcomputer or the like, a memory section 42 comprising a memory such as RAM and/or ROM, and an input section 43.

The control section 41 conducts the exchange of control signals with a remote controller (not shown) for performing operations of the indoor units 20, and primarily controls the various components of the indoor units 20 and the outdoor unit 30 in accordance with the air-conditioning load of the indoor units 20 (for example, the temperature difference between the set temperature and the indoor temperature). The control section 41 functions as the detection signal receiving section 41*a*, a compressor control section 41*b*, a protection control section 41*c*, and a time management section 41*d* by reading out and executing programs stored in the memory section 42.

Various types of information and programs to be performed by the control section 41 are stored in the memory section 42. The memory section 42 has a determination temperature memory area 42*a* and an ending time memory area 42*b*, both for storing numerical values used by the protection control section 41*c*.

(2-3-1) Control Section (2-3-1-1) Detection Signal Receiving Section

The detection signal receiving section 41*a* receives a signal outputted by the discharge pipe temperature sensor 51. The detection signal receiving section 41*a* reads the signal received from the discharge pipe temperature sensor 51 as a discharge pipe temperature $T_t$. The discharge pipe temperature $T_t$ is used by the protection control section 41*c*, described hereinafter, to decide whether or not to execute protection control and also to decide upon the detail of the protection control.

(2-3-1-2) Compressor Control Section

The compressor control section 41*b* decides and controls the starting and stopping of the compressor 31, as well as the driving frequency f; in accordance with factors such as the air-conditioning load of the indoor units 20 and various control signals. The compressor control section 41*b* transmits signals relating to the starting and stopping of the compressor 31 to the protection control section 41*c* and the time management section 41*d*, described hereinafter.

During first protection control, described hereinafter, the compressor control section 41*b* receives a command from the protection control section 41*c*, described hereinafter, and lowers the driving frequency f of the compressor 31 to a prescribed driving frequency $f_p$. When second protection control, described hereinafter, is performed, the compressor control section 41*b* receives a command from the protection control section 41*c*, described hereinafter, and stops the operation of the compressor 31.

(2-3-1-3) Protection Control Section

The protection control section 41*c* performs protection control on the compressor 31 while the compressor 31 is operating. More specifically, the protection control section 41*c* instructs execution and cancellation of two types of protection control in accordance with the numerical value of the discharge pipe temperature $T_t$. The detail (type) of protection control as well as the execution and cancellation thereof are decided by comparing the discharge pipe temperature $T_t$ and a low-temperature-side determination temperature $T_L$ and a high-temperature-side determination temperature $T_H$ called from the determination temperature memory area 42*a*, described hereinafter.

Different scenarios are described below.

Here, the relationship between the low-temperature-side determination temperature $T_L$ and the high-temperature-side determination temperature $T_H$ is configured as: low-temperature-side determination temperature $T_L$<high-temperature-side determination temperature $T_H$.

(a) Discharge Pipe Temperature $T_t \leq$ Low-Temperature-Side Determination Temperature $T_L$ The protection control section 41*c* decides to not perform protection control.

(b) Low-Temperature-Side Determination Temperature $T_L <$ Discharge Pipe Temperature $T_t \leq$ High-Temperature-Side Determination Temperature $T_H$ First protection control configured and arranged to lower the driving frequency f of the compressor 31 is performed. Specifically, the protection control section 41*c* instructs the compressor control section 41*b* to lower the driving frequency f to a prescribed driving frequency $f_p$. The driving frequency $f_p$ may be a fixed value such as a minimum value, or it may, tier example, be a fluctuating value that changes according to the driving frequency determined as optimal from factors such as the air-conditioning load of the indoor units 20.

In addition, the protection control section 41*c* may, simultaneously with or separately from the control of the driving frequency f, issue an instruction so as to enlarge (increase) the opening degree of the outdoor expansion valve 36 above a predetermined opening degree.

(c) Discharge Pipe Temperature $T_t >$ High-Temperature-Side Determination Temperature $T_H$ Second protection control, in which the operation of the compressor 31 is stopped, is performed. Specifically, the protection control section 41*c* instructs the compressor control section 41*b* to stop the compressor 31.

The protection control section 41*c* judges that a transition after the starting of the compressor 31 is in effect and that a steady state after an end of the transition is in effect, and the protection control section 41*c* retrieves the values that differ between during the transition and during the steady state as the low-temperature-side determination temperature $T_L$ and the high-temperature-side determination temperature $T_H$ from the determination temperature memory area 42*a*.

A transition is a time period during which the state of the refrigerant is not stable. The protection control section 41*c* judges a predetermined time following a starting of the compressor 31 to be the transition. More specifically, the protection control section 41*c* judges a time preceding the elapse of a transition ending distinction time $t_1$ (described hereinafter) from the starting of the compressor 31 to be the transition. A steady state is a time period during which the state of the refrigerant is stable. While the compressor 31 is operating, the protection control section 41*c* judges a time following the elapse of the transition ending distinction time $t_1$ from the starting of the compressor 31 to be the steady state. A difference between the transition and the steady state, is, for example, that the temperature difference between the discharge pipe temperature $T_t$ and the internal temperature of the compressor 31 during the transition may be greater than the temperature difference between the discharge pipe temperature $T_t$ and the internal temperature of the compressor 31 during the steady state. Differences between the transition and the steady state are described in detail hereinafter.

(2-31-4) Time Management Section

The time management section 41*d* performs time management on the various controls performed by the control section 41. Time management includes perceiving a time t following the starting of the compressor 31. The time t following the starting of the compressor 31 is perceived using signals relating to the starting and stopping of the compressor 31 transmitted from the compressor control section 41*b*.

(2-3-2) Memory Section (2-3-2-1) Determination Temperature Memory Area

The determination temperature memory area 42*a* stores a determination temperature used by the protection control section 41*c* to decide whether or not performing protection control and the detail of protection control. More specifically, this area stores a first low-temperature-side temperature $T_{L1}$ as the low-temperature-side determination temperature $T_L$ during transitions, a first high-temperature-side temperature $T_{H1}$ as the high-temperature-side determination temperature $T_H$ during transitions, a second low-temperature-side temperature $T_{L2}$ as the low-temperature-side determination temperature $T_L$ during steady states, and a second high-temperature-side temperature $T_{H2}$ as the high-temperature-side determination temperature $T_H$ during steady states.

These values have the following relationships: first low-temperature-side temperature $T_{L1}$ < first high-temperature-side temperature $T_{H1}$, second low-temperature-side temperature $T_{L2}$ < second high-temperature-side temperature $T_{H2}$, first low-temperature-side temperature $T_{L1}$ < second low-temperature-side temperature $T_{L2}$, and first high-temperature-side temperature $T_{H1}$ < second high-temperature-side temperature $T_{H2}$. In other words, the low-temperature-side temperatures (the first low-temperature-side temperature $T_{L1}$ and the second low-temperature-side temperature $T_{L2}$) are lower values than the corresponding high-temperature-side temperatures (the first high-temperature-side temperature $T_{H1}$ and the second high-temperature-side temperature $T_{H2}$). The first temperatures (the first low-temperature-side temperature $T_{L1}$ and the first high-temperature-side temperature are lower values than the corresponding second temperatures (the second low-temperature-side temperature $T_{L2}$ and the second high-temperature-side temperature $T_{H2}$).

In the present embodiment, the first low-temperature-side temperature $T_{L1}$, the first high-temperature-side temperature $T_{H1}$, the second low-temperature-side temperature $T_{L2}$, and the second high-temperature-side temperature $T_{H2}$ are values stored in advance in the determination temperature memory area 42*a*, but such an arrangement is not provided by way of limitation; these values may, for example, be rewritten by input from the input section 43, described hereinafter.

(2-3-2-2) Ending Time Memory Area

The ending time memory area 42*b* stores the transition ending distinction time $t_1$, which is used by the protection control section 41*c* to judge transitions and steady states.

The protection control section 41*c* judges that a transition is in effect if the transition ending distinction time $t_1$ has not yet elapsed since a starting of the compressor 31, and judges that a steady state is in effect if the transition ending distinction time $t_1$ has elapsed since the starting of the compressor 31.

The transition ending distinction time $t_1$ is information stored in advance in the ending time memory area 42*b*; however, the transition ending distinction time $t_1$ is not provided by way of such a limitation, and may, for example, be rewritten by input from the input section 43, described hereinafter.

(2-4-3) Input Section

The input section 43 is configured so that various information and various operation conditions are inputted.

(3) Flow of Processing Performed by Protection Control Section

The following is a description of the processing of transition/steady state judgment and determination temperature variation, as well as the processing relating to protection control, as performed by the protection control section 41*c*.

Figure 3:
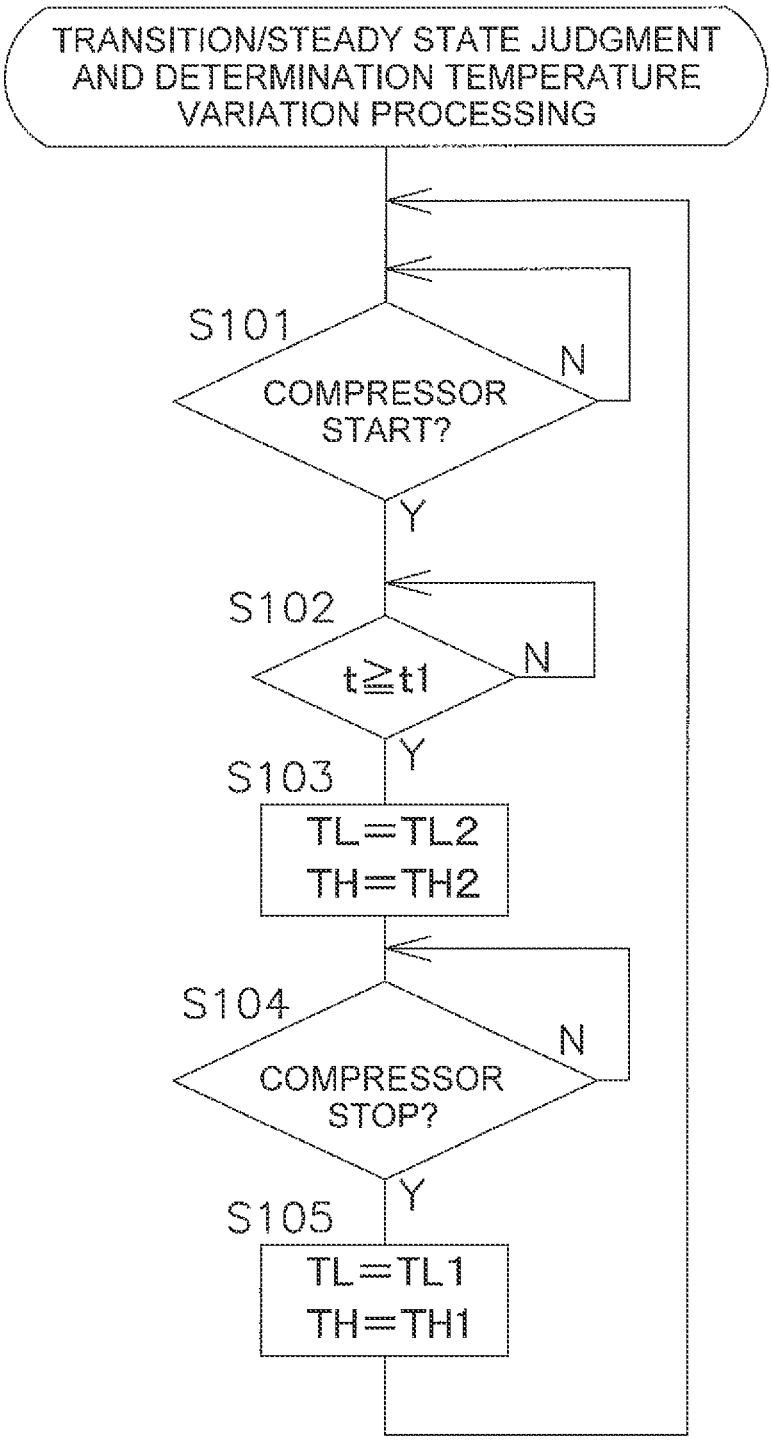
FIG. 3 is a flowchart of the processing of transition/steady state judgment and determination temperature variation in the air conditioning device of FIG. 1.

(3-1) Processing of Transition/Steady State Judgment and Determination Temperature Variation The transition/steady state judgment and determination temperature variation processing performed by the protection control section 41*c* is described based on the flowchart of FIG. 3. By "transition/steady state judgment" is meant a judgment made by the protection control section 41*c* that a transition following a starting of the compressor 31 is in effect and that a steady state following an end of the transition is in effect. By "determination temperature variation" is meant that the protection control section 41*c* changes the values retrieved from the determination temperature memory area 42*a* as the low-temperature-side determination temperature $T_L$ and the high-temperature-side determination temperature $T_H$, depending on during transitions or during steady states.

In step S101, the protection control section 41*c* judges whether or not a signal relating to the starting of the compressor 31 has been received from the compressor control section 41*b*. Step S101 is repeated until the protection control section 41*c* judges that a signal relating to the starting of the compressor 31 has been received. When the protection control section 41*c* judges that a signal relating to the starting of the compressor 31 has been received, the processing advances to step S102.

In step S102, the protection control section 41*c* judges whether or not a time t following the starting of the compressor 31 is a value equal to or greater than a transition ending distinction time $t_1$. Specifically, the protection control section 41*c* requests the time management section 41*d* for the time t following the starting of the compressor 31, and judges whether or not the time t is a value equal to or greater than the transition ending distinction time $t_1$ retrieved from the ending time memory area 42*b*. Step S102 is repeated until the protection control section 41*c* judges that the time t is a value equal to or greater than the transition ending distinction time $t_1$. When the protection control section 41*c* judges that the time t is equal to or greater than the transition ending distinction time $t_1$, the processing advances to step S103.

While the judgment of step S102 is being performed, the protection control section 41*c* judges that a transition is in effect. In other words, the protection control section 41*c* uses the first low-temperature-side temperature $T_{L1}$ as the low-temperature-side determination temperature $T_L$ and the first high-temperature-side temperature $T_{H1}$ as the high-temperature-side determination temperature $T_H$, for the determination temperatures of the processing relating to protection control.

In step S103, the protection control section 41*c* judges that the transition has ended. The protection control section 41*c* then changes the values retrieved from the determination temperature memory area 42*a* as the low-temperature-side determination temperature $T_L$ and the high-temperature-side determination temperature $T_H$. Specifically, the second low-temperature-side temperature $T_{L2}$ is retrieved as the low-temperature-side determination temperature $T_L$ and the second high-temperature-side temperature $T_{H2}$ is retrieved as the high-temperature-side determination temperature $T_H$ by the protection control section 41*c*. The retrieved low-temperature-side determination temperature $T_L$ and high-temperature-side determination temperature $T_H$ are used as determination temperatures for the processing relating to protection control.

In step S104, the protection control section 41*c* judges whether or not a signal relating to the stopping of the compressor 31 has been received from the compressor control section 41*b*. Step S104 is repeated until the protection control section 41*c* judges that a signal relating to the stopping of the compressor 31 has been received. When the protection control section 41*c* judges that a signal relating to the stopping of the compressor 31 has been received, the processing advances to step S105.

While the judgment of step S104 is being performed, the protection control section 41*c* judges that a steady state is in effect. In other words, while the judgment of step S104 is being performed, the protection control section 41*c* uses the second low-temperature-side temperature $T_{L2}$ as the low-temperature-side determination temperature $T_L$ and the second high-temperature-side temperature $T_{H2}$ as the high-temperature-side determination temperature $T_H$, for the determination temperatures of the processing relating to protection control.

In step S105, the protection control section 41*c* judges that the operation of the compressor 31 has ended. The protection control section 41*c* then changes the values retrieved from the determination temperature memory area 42*a* as the low-temperature-side determination temperature $T_L$ and the high-temperature-side determination temperature $T_H$. Specifically, the first low-temperature-side temperature $T_{L1}$ is retrieved as the low-temperature-side determination temperature $T_L$ and the first high-temperature-side temperature $T_{H1}$ is retrieved as the high-temperature-side determination temperature $T_H$ by the protection control section 41*c*. The processing then returns to step S101. The retrieved low-temperature-side determination temperature $T_L$ and high-temperature-side determination temperature $T_H$ are maintained without changes until the processing next advances to step S103.

(3-2) Processing Relating to Protection Control

Protection control is control configured and arranged to protect the operating compressor 31 from failures or the like caused by overheating. In the processing relating to protection control, the values retrieved from the determination temperature memory area 42*a* as the low-temperature-side determination temperature $T_L$ and the high-temperature-side determination temperature $T_H$ by the protection control section 41*c* as a result of the processing of determination temperature variation described above are used as determination temperatures.

Figure 4:
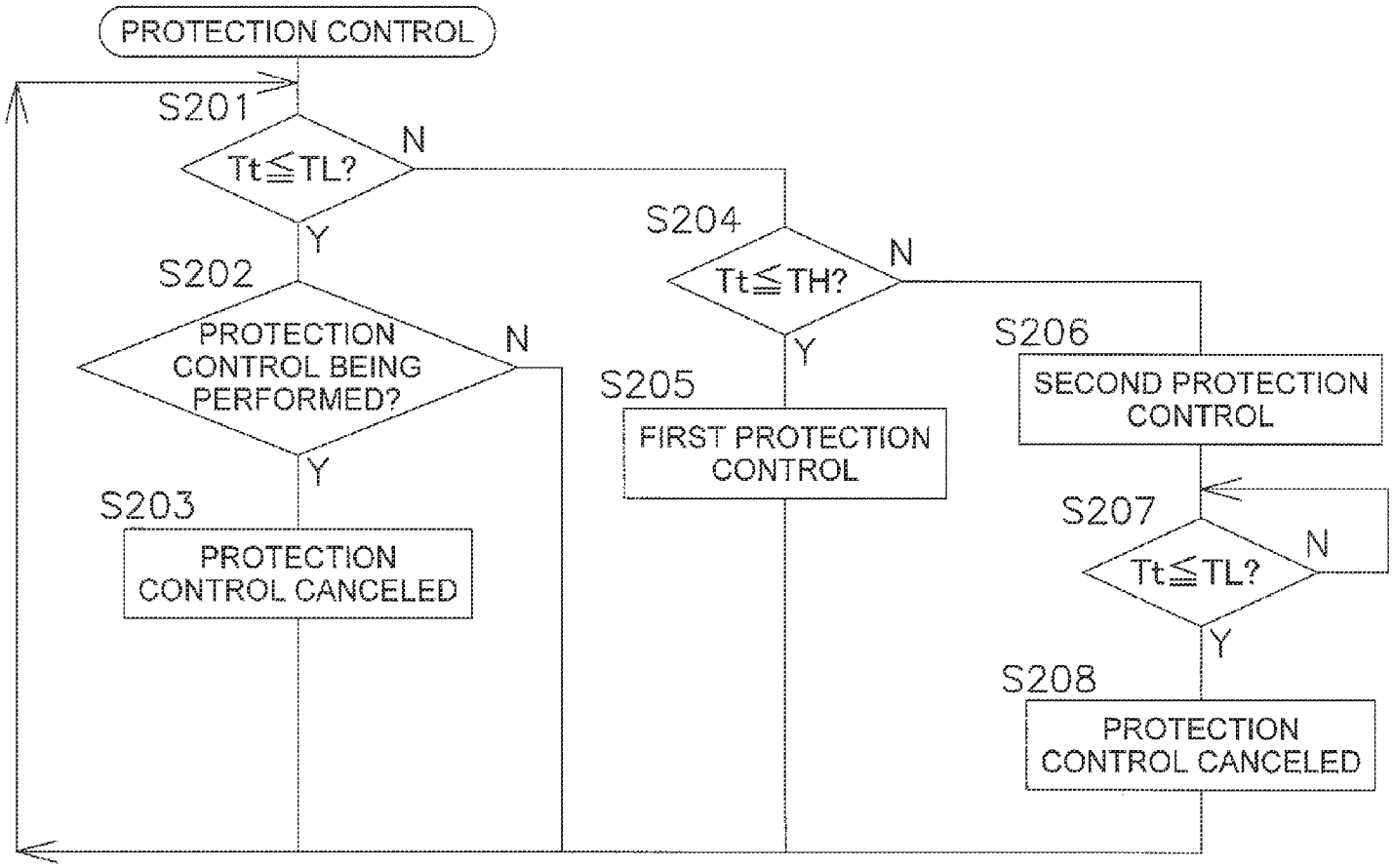
FIG. 4 is a flowchart of the processing related to protection control of the compressor in the air conditioning device of FIG. 1.

The processing relating to protection control is described based on the flowchart of FIG. 4.

In step S201, the protection control section 41*c* judges whether or not the discharge pipe temperature $T_t$ is equal to or less than the low-temperature-side determination temperature $T_L$. When the discharge pipe temperature $T_t$ is judged to be equal to or less than the low-temperature-side determination temperature $T_L$, the processing advances to step S202, and when the discharge pipe temperature Tt is judged to be greater than the low-temperature-side determination temperature $T_L$, the processing advances to step S204.

In step S202, the protection control section 41*c* judges whether or not the first protection control is being performed. When it is judged that the first protection control is being performed, the processing advances to step S203, and when it is judged that the first protection control is not being performed, the processing returns to step S201.

In step S203, the protection control section 41*c* cancels the execution of first protection control. More specifically, the protection control section 41*c* instructs the compressor control section 41*b* to cancel the execution of the first protection control. The processing then returns to step S201.

In step S204, the protection control section 41*c* judges whether or not the discharge pipe temperature $T_t$ is equal to or less than the high-temperature-side determination temperature $T_H$. When the discharge pipe temperature $T_t$ is judged to be equal to or less than the high-temperature-side determination temperature $T_H$, the processing advances to step S205, and when the discharge pipe temperature $T_t$ is judged to be greater than the high-temperature-side determination temperature $T_H$, the processing advances to step S206.

In step S205, the first protection control is performed by the protection control section 41*c*. The first protection control is control configured and arranged to lower the driving frequency f of the compressor 31. The protection control section 41*c* instructs the compressor control section 41*h* to lower the driving frequency f to the predetermined driving frequency $f_p$. The processing then returns to step S201.

When the first protection control is already being performed, the first protection control continues unchanged. In this case, the protection control section 41*c* does not issue an instruction to the compressor control section 41*b* again to lower the driving frequency f.

In step S206, the second protection control is performed by the protection control section 41*c*. In the second protection control, the operation of the compressor 31 is stopped. More specifically, the protection control section 41*c* instructs the compressor control section 41*b* to stop the compressor 31. As a result, refrigerant ceases to flow in the refrigerant circuit 10. The processing then advances to step S207.

In step S207, the protection control section 41*c* judges whether or not the discharge pipe temperature $T_t$ is equal to or less than the low-temperature-side determination temperature $F_L$ stored in the determination temperature memory area 42*a*. Step S207 is repeated until the discharge pipe temperature $T_t$ is judged to be equal to or less than the low-temperature-side determination temperature $T_L$. When the discharge pipe temperature $T_t$ is judged to be equal to or less than the low-temperature-side determination temperature $T_L$, the processing advances to step S208.

In step S208, the protection control section 41*c* cancels protection control. More specifically, the protection control section 41*c* instructs the compressor control section 41*b* to cancel the stopping of the compressor 31. When an instruction has been issued to the compressor control section 41*b* to lower the driving frequency f to the predetermined driving frequency $f_p$, the protection control section 41*c* also instructs the compressor control section 41*b* to cancel this control. The processing then returns to step S201.

(4) Difference Between Transition and Steady State

The difference between a transition and a steady state is described below.

Figure 5:
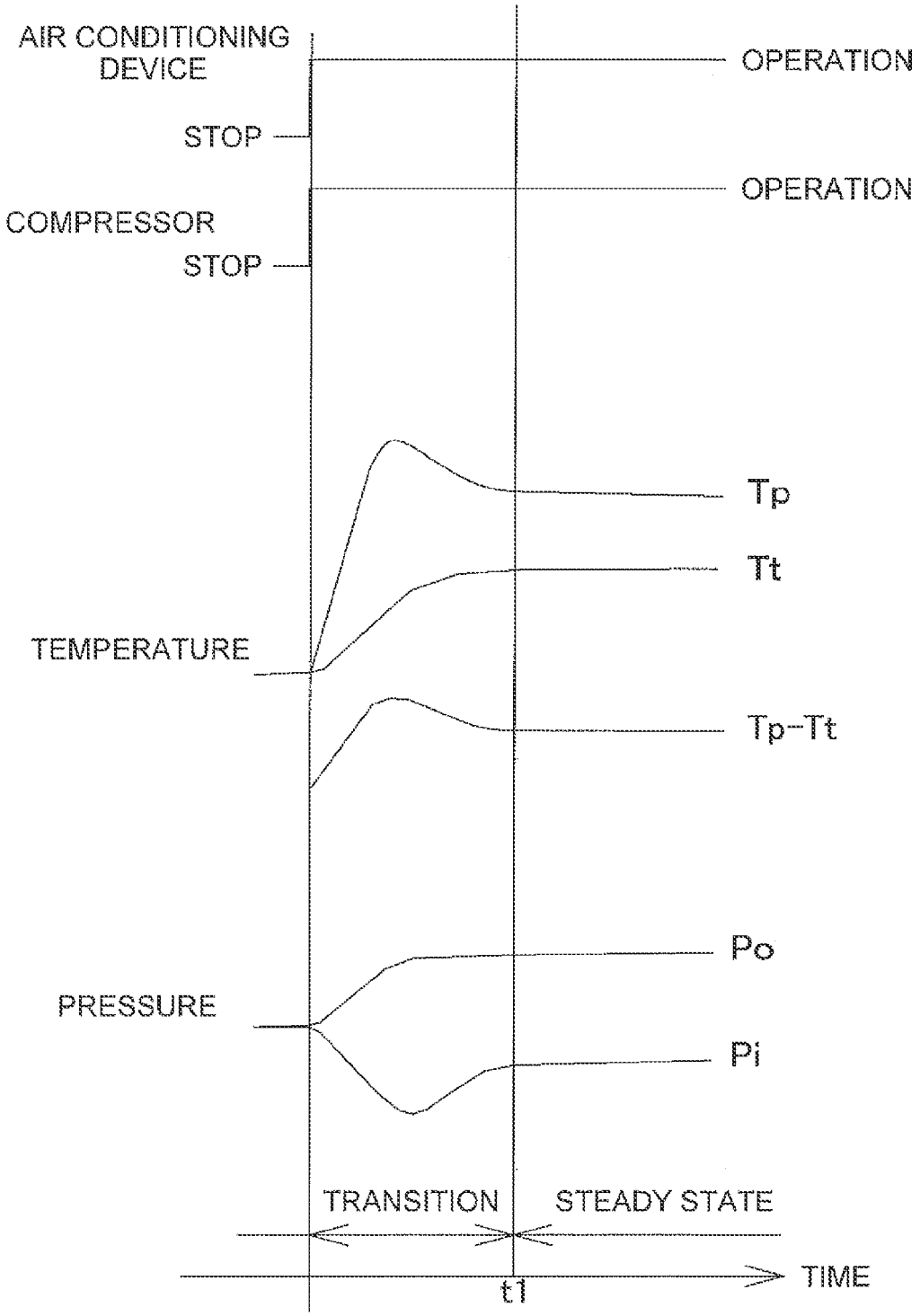
FIG. 5 is a graph depicting the changes over time in the discharge pipe temperature, the discharge port temperature, the temperature difference between the discharge pipe temperature and the discharge port temperature, the discharge pressure, and the suction pressure in the compressor used in the air conditioning device of FIG. 1.

First, FIG. 5 is used to describe the changes over time in the discharge pipe temperature $T_t$, the internal temperature of the compressor 31, the temperature difference between the discharge pipe temperature $T_t$ and the internal temperature of the compressor 31, the discharge pressure $P_o$ which is the pressure of refrigerant discharged from the compressor 31, and the suction pressure $P_i$ which is the pressure of refrigerant taken in by the compressor 31, under constant operating conditions. The description herein uses a discharge port temperature $T_p$ as the internal temperature of the compressor 31. By "discharge port temperature $T_p$" is meant the temperature of refrigerant that has just been discharged from the compression chamber of the compression mechanism of the compressor 31.

First is a description of changes over time in the discharge pipe temperature Tt, the discharge port temperature $T_p$, and the temperature difference ($T_p$–$T_t$) between the discharge port temperature $T_p$ and the discharge pipe temperature $T_t$.

When the air conditioning device 1 starts operation as in FIG. 5, the compressor 31 starts up. After the compressor 31 starts up, the discharge pipe temperature $T_t$ and the discharge port temperature $T_p$ begin to increase. The graph depicting the change in the discharge pipe temperature $T_t$ shows a curve that increases after the starting of the compressor 31 and approaches a substantially constant value, as in FIG. 5. The graph depicting the change in the discharge port temperature $T_p$ shows a curve that temporarily increases significantly to a maximum value, and thereafter decreases and approaches a substantially constant value. Because of the difference in the trends of these temperature changes between the discharge port temperature $T_p$ and the discharge pipe temperature $T_t$ after the starting of the compressor 31, the graph depicting the change in the temperature difference between the discharge port temperature $T_p$ and the discharge pipe temperature $T_t$ also shows a curve that temporarily increases significantly to a maximum value, and thereafter decreases and approaches a substantially constant value. When the temperature difference between the discharge port temperature $T_p$ and the discharge pipe temperature $T_t$ fluctuates over time, a transition is in effect, and when the temperature difference is a substantially constant value, a steady state is in effect, as in FIG. 5. As is understood from FIG. 5, the temperature difference between the discharge port temperature $T_p$ and the discharge pipe temperature $T_t$ reaches a maximum during a transition. In other words, comparing the transition and the steady state, there could be a situation in which the discharge port temperature $T_p$ during the transition is higher when the discharge pipe temperature $T_t$ is the same. One cause of the difference in the trends of the temperature changes between the discharge port temperature $T_p$ and the discharge pipe temperature $T_t$ after the starting of the compressor 31 is that it takes time for the refrigerant temperature to reach the discharge pipe.

Next is a description of the changes over time in the discharge pressure $P_o$ and the suction pressure Pi.

First, the graph depicting the change in the discharge pressure $P_o$ shows a curve that increases after the starting of the compressor 31 and approaches a substantially constant value, as in FIG. 5. The graph depicting the change in the suction pressure $P_i$ shows a curve that temporarily decreases to a minimum value, and then increases and approaches a substantially constant value. In the graph depicting the change in the suction pressure $P_i$, the timing when a local minimum is reached (the timing when the curve reaches the minimum value and thereafter increases) is included in the transition.

Therefore, if the suction pressure $P_i$ of the compressor 31 is measured during trial operation or the like under constant operating conditions and the transition is set so as to include the timing when the suction pipe pressure $P_i$ reaches a local minimum, an appropriate transition ending distinction time $t_1$ can be derived by a simple method without actually measuring the discharge port temperature during a trial operation or the like.

(5) Characteristics (5-1)

The air conditioning device 1 of the present embodiment comprises the compressor 31, the discharge pipe temperature sensor 51, and the protection control section 41*c*. The compressor 31 compresses a refrigerant. The discharge pipe temperature sensor 51 detects the temperature of the refrigerant discharged from the compressor 31 as the discharge pipe temperature $T_t$ at the discharge pipe outside of the compressor 31. The protection control section 41*c* judges that a transition following a starting of the compressor 31 is in effect and that a steady state following an end the transition in which the state of the refrigerant is stable in effect. During a transition, the protection control section 41*c* performs the first protection control and the second protection control of the compressor 31 respectively when the discharge pipe temperature $T_t$ detected by the discharge pipe temperature sensor 51 exceeds the first low-temperature-side temperature $T_{L1}$ and the first high-temperature-side temperature $T_{H1}$ (first determination temperatures) respectively. During a steady state, the protection control section 41*c* performs the first protection control and second protection control of the compressor 31 respectively when the discharge pipe temperature $T_t$ exceeds the second low-temperature-side temperature $T_{L2}$ and the second high-temperature-side temperature $T_{H2}$ (second determination temperatures) respectively.

Transitions following the starting of the compressor 31 and steady states in which the state of the refrigerant is stable are judged, and protection control of the compressor 31 is performed based on the determination temperatures which are different between during transitions and during steady states. Therefore, even when the temperature difference between the discharge pipe temperature $T_t$ and the internal temperature of the compressor 31 during a transition is different from the temperature difference between the discharge pipe temperature Tt and the internal temperature of the compressor 31 during a steady state, appropriate protection control can be performed before the interior of the compressor 31 overheats. As a result, a highly reliable air conditioning device 1 is achieved.

(5-2)

In the air conditioning device 1 of the present embodiment, the transition includes the timing when the suction pressure $P_i$ of the compressor 31 reaches a local minimum.

Here, the transition can be judged using the change in the suction pressure $P_i$ of the compressor 31. The transition therefore can be determined in a simple and appropriate manner without performing actual measurement of the temperature difference between the internal temperature of the compressor 31 (e.g. the discharge port temperature $T_p$) and the discharge pipe temperature $T_t$ during trial operation or the like and the appropriate protection control can be performed before the interior of the compressor 31 overheats. As a result, a highly reliable air conditioning device 1 is achieved.

(5-3)

In the air conditioning device 1 of the present embodiment, the protection control section 41*c* judges that a transition is in effect until the transition ending distinction time $t_1$ elapses after the starting of the compressor 31, and judges that a steady state is in effect after the transition ending distinction time $t_1$ has elapsed.

Because transitions and steady states are judged using the time t after the starting of the compressor 31, the end of the transition can easily be judged to vary the determination temperature. Therefore, the appropriate protection control can be performed before the interior of the compressor 31 overheats. As a result, a highly reliable air conditioning device 1 is achieved.

(5-4)

In the air conditioning device 1 of the present embodiment, the first low-temperature-side temperature $T_{L1}$ and the first high-temperature-side temperature $T_{H1}$ are lower than the second low-temperature-side temperature $T_{L2}$ and the second high-temperature-side temperature $T_{H2}$ respectively.

When R32 is used as the refrigerant as in the present embodiment, there are cases in which the temperature difference between the discharge pipe temperature 717*t* and the internal temperature of the compressor 31 is greater during a transition following a starting of the compressor 31 than during a steady state, but the appropriate protection control can be performed.

(6) Modifications

Modifications of the present embodiment are presented below. A plurality of modifications may be combined as appropriate.

(6-1) Modification A

In the above embodiment, R32 is used as the refrigerant, but such an arrangement is not provided by way of limitation; another refrigerant may be used, such as R410A or R407C.

With a refrigerant having a large specific heat ratio κ such as R32, the present invention is particularly useful, in particular because the discharge pipe temperature $T_t$ and the internal temperature of the compressor 31 during a transition tend to be higher than the discharge pipe temperature $T_t$ and the internal temperature of the compressor 31 during a steady state.

The air conditioning device 1 may be designed to be capable of switching among a plurality of refrigerants. For example, an air conditioning device 1 may use R410A, R407C. and R32 as refrigerants, and by being designated the type of refrigerant being used from the input section 43 of the control unit 40, the operating conditions may be varied by the control unit 40 and an operation appropriate for the refrigerant being used may be performed.

In this case, first determination temperatures (the first low-temperature-side temperature $T_{L1}$ and the first high-temperature-side temperature $T_{H1}$) and second determination temperatures (the second low-temperature-side temperature $T_{L2}$ and the second high-temperature-side temperature $T_{H2}$) may be prepared for each refrigerant.

(6-2) Modification B

In the above embodiment, the first and second protection control are performed as protection controls, but such an arrangement is not provided by way of limitation; many other types of protection control may be performed.

Another option is to use only one type of protection control; for example, the second protection control.

(6-3) Modification C

In the above embodiment, different values stored in the determination temperature memory area 2*a* are retrieved (the retrieved values are varied) for transitions and steady states and used as the low-temperature-side determination temperature $T_L$ and the high-temperature-side determination temperature $T_H$, but such an arrangement is not provided by way of limitation. For example, the low-temperature-side determination temperature $T_L$ and the high-temperature-side determination temperature $T_H$ may be calculated by a mathematical formula so that the low-temperature-side determination temperature $T_L$ and the high-temperature-side determination temperature $T_H$ vary between during transitions and during steady states.

(6-4) Modification D

In the above embodiment, the protection control section 41*c* judges only two states: transitions and steady states, but such an arrangement is not provided by way of limitation; for example, a transition may be divided into further categories (e.g., a first transition to an $N^{th}$ transition), and different determination temperatures may be prepared for each different transition.

(6-5) Modification E

In the above embodiment, the determination temperatures are varied merely depending on whether a transition is in effect or a steady state is in effect, but another option is to vary the determination temperatures also in accordance with the driving frequency f of the compressor, as in Patent Literature 1, for example.

It is thereby easy to perform more appropriate protection control.

(6-6) Modification F

In the above embodiment, after the second protection control has been performed, protection control is not canceled until the discharge pipe temperature $T_t$ is equal to or less than the low-temperature-side determination temperature $T_L$; however, such an arrangement is not provided by way of limitation. Provided, for example, that the discharge pipe temperature $T_t$ is lower than the high-temperature-side determination temperature $T_H$, second protection control may be canceled and the operation of the compressor 31 may be restarted.

(6-7) Modification G

In the above embodiment, the compressor 31 is an inverter compressor capable of varying the driving frequency f, but such an arrangement is not provided by way of limitation; the compressor 31 may be non-inverter type (incapable of varying the driving frequency f). In this case, the first protection control for varying the driving frequency f is not performed.

INDUSTRIAL APPLICABILITY

According to the present invention, a highly reliable refrigerating device is realized where appropriate protection control for a compressor is performed regardless of during the transition or during the stable state.

What is claimed is:

1. A refrigerating device comprising:

a compressor arranged and configured to compress a refrigerant;

a temperature detector arranged and configured to detect a temperature of the refrigerant discharged from the compressor on an outside of the compressor;

a time management section configured to perceive a time elapsed since a starting of the compressor;

a determination temperature memory section configured to store a first determination temperature and a second determination temperature, the first determination temperature being smaller than the second determination temperature;

an ending time memory section configured to store a transition ending distinction time; and a protection control section configured to determine that a transition is in effect from the starting of the compressor until the time perceived by the time management section reaches the transition ending distinction time, determine that a steady state is in effect after the time perceived by the time management section has reached the transition ending distinction time, set a determination temperature to the first determination temperature by retrieving the first determination temperature from the determination temperature memory section if the transition is determined to be in effect, or to the second determination temperature by retrieving the second determination temperature from the determination temperature memory section if the steady state is determined to be in effect, perform a protection control on the compressor when a detected temperature detected by the temperature detector exceeds the set determination temperature, the set determination temperature having such a value that the protection control is executed before an interior of the compressor overheats.

2. The refrigerating device according to claim 1, wherein the transition includes a timing when a suction pressure of the compressor reaches a local minimum.

3. The refrigerating device according to claim 1, wherein the protection control is a first protection control that lowers the driving frequency of the compressor.

4. The refrigerating device according to claim 1, wherein the protection control is a second protection control that stops the operation of the compressor.

5. A refrigerating device comprising:

a compressor arranged and configured to compress a refrigerant;

a temperature detector arranged and configured to detect a temperature of the refrigerant discharged from the compressor on an outside of the compressor;

a time management section configured to perceive a time elapsed since a starting of the compressor;

a determination temperature memory section configured to store a first low-temperature-side determination temperature, a second low-temperature-side determination temperature, a first high-temperature-side determination temperature, a second high-temperature-side determination temperature, the first low-temperature-side determination temperature being smaller than the second low-temperature-side determination temperature, the first high-temperature-side determination temperature being smaller than the second high-temperature-side determination temperature;

an ending time memory section configured to store a transition ending distinction time; and a protection control section configured to determine that a transition is in effect until the time perceived by the time management section reaches the transition ending distinction time, judge that a steady state is in effect after the time perceived by the time management section reaches the transition ending distinction time, set a low-temperature-side determination temperature to the first low-temperature-side determination temperature by retrieving the first low-temperature-side determination temperature from the determining temperature memory section if the transition is determined to be in effect, or to the second low-temperature-side determination temperature by retrieving the second low-temperature-side determination temperature from the determination temperature memory section if the steady state is determined to be in effect, set a high-temperature-side determination temperature to the first high-temperature-side determination temperature by retrieving the first high-temperature-side determination temperature from the determination temperature memory section if the transition is determined to be in effect, or to the second high-temperature-side determination temperature by retrieving the second high-temperature-side determination temperature from the determination temperature memory section if the steady state is determined to be in effect, perform a first protection control on the compressor when a detected temperature detected by the temperature detector is larger than the set low-temperature-side determination temperature and smaller than or equal to the set high-side temperature determination temperature, perform a second protection control on the compressor when the detected temperature detected by the temperature detector is larger than the set high-side temperature determination temperature, the set low-side and high-side determination temperatures having such values that the first and second protection controls are executed before an interior of the compressor overheats.

6. The refrigerating device according to claim 5, wherein the first protection control lowers the driving frequency of the compressor, and the second protection control stops the operation of the compressor.

* * * * *